US009697814B2

(12) United States Patent
Zhu

(10) Patent No.: US 9,697,814 B2
(45) Date of Patent: Jul. 4, 2017

(54) METHOD AND DEVICE FOR CHANGING INTERPRETATION STYLE OF MUSIC, AND EQUIPMENT

(71) Applicant: SAMSUNG ELECTRONICS CO., LTD., Suwon-si (KR)

(72) Inventor: Heng Zhu, Beijing (CN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/619,784

(22) Filed: Feb. 11, 2015

(65) Prior Publication Data

US 2015/0228264 A1 Aug. 13, 2015

(30) Foreign Application Priority Data

Feb. 11, 2014 (CN) ..... 2014 1 0047305

(51) Int. Cl.
*G10H 1/06* (2006.01)
*G10H 1/00* (2006.01)
(Continued)

(52) U.S. Cl.
CPC ..... *G10H 1/06* (2013.01); *G10H 1/0008* (2013.01); *G10H 1/36* (2013.01); *G10H 7/02* (2013.01);
(Continued)

(58) Field of Classification Search
CPC ..... G10H 7/02; G10H 1/008; G10H 1/06
(Continued)

(56) References Cited

U.S. PATENT DOCUMENTS 8,431,811 B2 * 4/2013 Riopelle ..... G10H 1/00 84/609
2002/0166437 A1 * 11/2002 Nishitani ..... G10H 1/0008 84/600
(Continued)

FOREIGN PATENT DOCUMENTS

KR 10-2011-0004930 A 1/2011

*Primary Examiner* — David Warren
*Assistant Examiner* — Christina Schreiber
(74) *Attorney, Agent, or Firm* — Sughrue Mion, PLLC

(57) ABSTRACT

The embodiments of the present invention provide a method for changing the interpretation style of music, comprising the following steps of: analyzing an audio file to obtain a waveform audio file; acquiring behavior information of a user, and converting the behavior information into control parameter information; and, processing the waveform audio file according to the control parameter information and outputting music that has been changed in terms of interpretation style. The embodiments of the present invention further provide a device for changing the interpretation style of music, comprising: an analysis module, a control information acquisition module and a processing and outputting module. By the technical solutions provided by the present invention, a user may change the interpretation style of music according to the current emotional needs, so that the diverse demands of the user are satisfied, and the user experience is improved; further, outputting a waveform audio file in real time solves the problem on time delay in the prior art, so that a user can better interact with friends in real time to share the music that has been changed in terms of interpretation style.

16 Claims, 10 Drawing Sheets

(51) Int. Cl.

| | |
|---|---|
| ***G10H 1/36*** | (2006.01) |
| ***G10H 7/00*** | (2006.01) |
| ***G10H 7/02*** | (2006.01) |
| ***G10H 7/04*** | (2006.01) |

(52) U.S. Cl.
CPC ..... *G10H 7/04* (2013.01); *G10H 2210/036* (2013.01); *G10H 2220/395* (2013.01)

(58) Field of Classification Search
USPC ..... 84/634, 604
See application file for complete search history.

(56) References Cited

U.S. PATENT DOCUMENTS

| | | | | |
|---|---|---|---|---|
| 2003/0024375 | A1* | 2/2003 | Sitrick | G09B 15/002 84/477 R |
| 2006/0220882 | A1* | 10/2006 | Makino | A63B 69/0028 340/573.1 |
| 2008/0078282 | A1* | 4/2008 | Saijo | G10H 1/0008 84/611 |
| 2008/0306619 | A1* | 12/2008 | Cerra | G11B 27/10 700/94 |
| 2010/0173709 | A1* | 7/2010 | Horovitz | A63F 13/10 463/35 |
| 2011/0009713 | A1* | 1/2011 | Feinberg | A61B 5/0205 600/301 |
| 2011/0252951 | A1* | 10/2011 | Leavitt | G10H 1/40 84/645 |
| 2013/0032023 | A1* | 2/2013 | Pulley | G10H 1/0066 84/645 |
| 2015/0228264 | A1* | 8/2015 | Zhu | G10H 1/0008 84/604 |

* cited by examiner

METHOD AND DEVICE FOR CHANGING INTERPRETATION STYLE OF MUSIC, AND EQUIPMENT

RELATED APPLICATIONS

This application claims the benefit of the Chinese Patent Application No. 201410047305.8, filed on Feb. 11, 2014, in the State Intellectual Property Office of the P.R.China, the disclosures of which are incorporated herein in their entirety by reference.

BACKGROUND

1. Field

One or more embodiments of the present invention relates to the technical field of terminal equipment, particularly to a method and device for changing the interpretation style of music, and equipment.

2. Description of the Related Art

As shown in FIG. 1, a conventional manifestation mode of music in multimedia equipment is shown: a music file is decoded by a player and then converted into digital signals that are finally converted into analog signals by a D/A converter. Specifically, compressed music files of various formats are decoded by a music player, and the decoded digital signals are converted by a D/A converter and then transmitted, in form of analog signals, to sound player equipment for playing, such as loudspeakers or sound boxes. Human ears receive the above sounds. It can be known from FIG. 1 that music is stored in multimedia equipment in various ways, while people listen to music by a music player.

In this case, the role of a person is just a receiver. Although stimulated in the auditory sense, a person seems to be actually there and resonates with the music due to synesthesia. The most common resonance is beating with the body. A person even thinks that the rhythm and force of the original song are not enough sometimes when getting fascinated and wants to add something to the original song thus to experience different interpretation styles of one song.

In addition, a singer might interpret a same song in different ways according to the current mood and situation. However, as the music stored by a user in a player is fixed, the user can listen to only one style.

Therefore, it is necessary to propose a solution capable of changing the interpretation style of music, whereby a user may change the interpretation style of music according to the current emotional needs thus to satisfy the diverse demands and improve the user experience.

SUMMARY

To at least solve one of the above technical defects, an object of the present invention is particularly to provide a method and device for changing the interpretation style of music. By acquiring behavior information of a user, processing a waveform audio file according to the behavior information of the user, and outputting music that has been changed in terms of interpretation style, the present invention solves the problems in the prior art that, a user enjoys the songs in a player in a fixed and single interpretation style only, the diverse demands of the user can not be satisfied and the user experience is low.

To achieve the above object, in one aspect, an embodiment of the present invention provides a method for changing the interpretation style of music, comprising the following steps of:

analyzing an audio file to obtain a waveform audio file;

acquiring behavior information of a user, and converting the behavior information into control parameter information; and processing the waveform audio file according to the control parameter information and outputting music that has been changed in terms of interpretation style.

In another aspect, an embodiment of the present invention provides a device for changing the interpretation style of music, comprising an analysis module, a control information acquisition module and a processing and outputting module, the analysis module is configured to analyze an audio file to obtain a waveform audio file;

the control information acquisition module is configured to acquire behavior information of a user and convert the behavior information into control parameter information; and the processing and outputting module is configured to process the waveform audio file according to the control parameter information and output music that has been changed in terms of interpretation style.

In another aspect, an embodiment of the present invention provides terminal equipment, comprising the above-mentioned device for changing the interpretation style of music.

The embodiments provided by the present invention have one or more of the following advantages:

in the embodiments provided by the present invention, by analyzing an audio file to obtain a waveform audio file; acquiring behavior information of a user, and converting the behavior information into control parameter information; and, processing the waveform audio file according to the control parameter information and outputting music that has been changed in terms of interpretation style, a user may change the interpretation style of music according to the current emotional needs, so that the diverse demands of the user are satisfied, and the user experience is improved. The above solutions as provided by the present invention just make minor modification to the existing systems, and hence will not influence the system compatibility. Moreover, the implementations are both simple and highly effective.

Further aspects and advantageous of the present inventions will be appreciated and become apparent from the descriptions below, or will be well learned from the practice of the present invention.

BRIEF DESCRIPTION OF THE DRAWINGS

The foregoing and/or further aspects and advantages of the present invention will become apparent and be more readily appreciated from the following descriptions of embodiments referring to the drawings. In the drawings.

DETAILED DESCRIPTION

Figure 1:
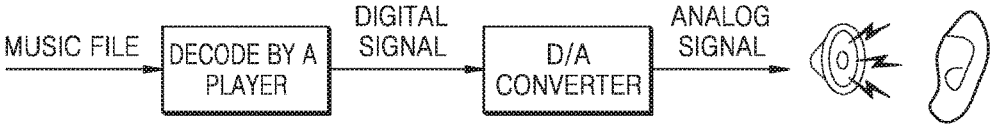
FIG. 1 (Prior Art)
FIG. 1 is a schematic diagram of a conventional manifestation mode of music in multimedia equipment.

The embodiments of the present invention will be described in details as below, and the examples of these embodiments have been illustrated in the drawings, in which the identical or similar reference numerals, throughout, refer to the identical or similar elements or elements having identical or similar functions. These examples described by reference to the drawings are illustrative for the purpose of explaining the present invention only, which shall not be regarded as constituting any limitations thereto.

It should be appreciated by a person skilled in the art that, unless particularly specified, the "one", "a (an)", "the (said)" and "this (that)" used herein in single forms also refer to plural forms. It should be further understood that, the wordings "include (comprise)" used in the description refer to the existence of the corresponding features, integers, steps, operations, elements and/or components without excluding the possibility of existing or incorporating one or more other features, integers, steps, operations, elements, components and/or groups thereof. It should be realized that when one element is defined to be "connected" or "coupled" to another element, it can be connected or coupled to another element directly or by an intermediate element. In addition, the "connecting" or "coupling" used herein may contain wireless connecting or coupling. The wording "and/or" used herein include any individual of or all the combinations of one or more related items listed herein.

It should be appreciated by a person skilled in the art that, all the terms used herein (including technical terms and scientific terms), unless otherwise specified, refer to the general meanings well known for those skilled in the art to which the present invention pertains. It should also be understood that, the terms, such as that defined in the general dictionaries, refer to the meanings consistent with the context of the prior art, and shall not be interpreted excessively ideally or formally, unless as specified herein.

It should be appreciated by the person skilled in the art that, the "terminal" and "terminal equipment" used herein include both the device provided with only radio signal transceiver incapable of transmitting and the device provided with hardware capable of receiving and transmitting for bidirectional communication on two-way communication links. Such device may include: a cellular or other communication device with or without multiplex display; a PCS that may incorporate functions of speech and data process as well as facsimile and/or data communication; a PDA that may comprise RF receiver and receivers of pager, access of Internet/Intranet, web browser, notepad, calendar and/or GPS; and/or conventional, laptop or palmtop computer or other devices provided with RF receiver. The "UE" and "terminal" used herein may be handheld, transportable, installable in (aero, marine and/or land) communication medias or adaptive and/or configured to operate locally and/or operate in distributed at any other locations on the earth/in the space. The "UE" and "terminal" used herein may also be communication terminal, internet terminal and music/video player terminal, such as PDA, MID (Mobile Internet Device) and/or mobile phones with functions of music/video play. The "terminal" and "terminal equipment" used herein may also be devices such as smart television and set top box.

To achieve the object of the present invention, an embodiment of the present invention provides a method for changing the interpretation style of music, comprising the following steps of:

analyzing an audio file to obtain a waveform audio file;

acquiring behavior information of a user, and converting the behavior information into control parameter information; and processing the waveform audio file according to the control parameter information and outputting music that has been changed in terms of interpretation style.

In the embodiment of the present invention as described above, by analyzing an audio file to obtain a waveform audio file; acquiring behavior information of a user, and converting the behavior information into control parameter information; and, processing the waveform audio file according to the control parameter information and outputting music that has been changed in terms of interpretation style, a user may change the interpretation style of music according to the current emotional needs, so that the diverse demands of the user are satisfied, and the user experience is improved.

Figure 2:
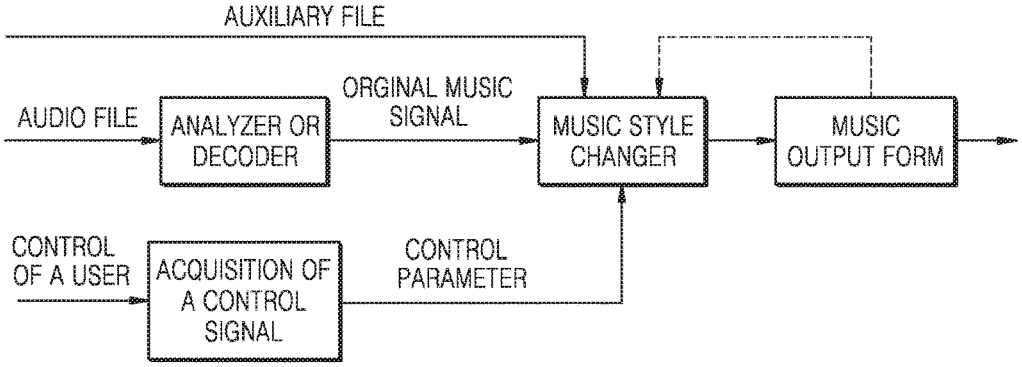
FIG. 2 is a flowchart of processing of a solution for changing the style of music in an embodiment of a method for changing the interpretation style of music according to the present invention.

As shown in FIG. 2, a flowchart of processing of a solution for changing the style of music in an embodiment of a method for changing the interpretation style of music according to the present invention is shown. The present invention will be described as below referring to FIG. 2.

With the widespread use of various sensors in multimedia equipment, particularly in mobile terminals, and the rapid development thereof, it is possible to receive a body movement of a user in real time. These control signals are converted into a manifestation mode desired by the user, and thus the original song may be changed. The changed song may be played in real time, that is, the user can listen to the song immediately. Alternatively, the user may store and share the changed song. Specifically:

processing an audio file by an analyzer or decoder to obtain original music signals, specifically: analyzing or decoding an audio file by an audio file analyzer or a decoder to obtain music signals associated with the original audio file;

acquiring corresponding control signals from the control of the user thus to obtain corresponding control parameters;

processing by a music style changer using other auxiliary files, for example, a lyric file, the music signals associated with the original audio file and the control parameters of the user, and then outputting music that has been changed in terms of interpretation style.

Figure 3:
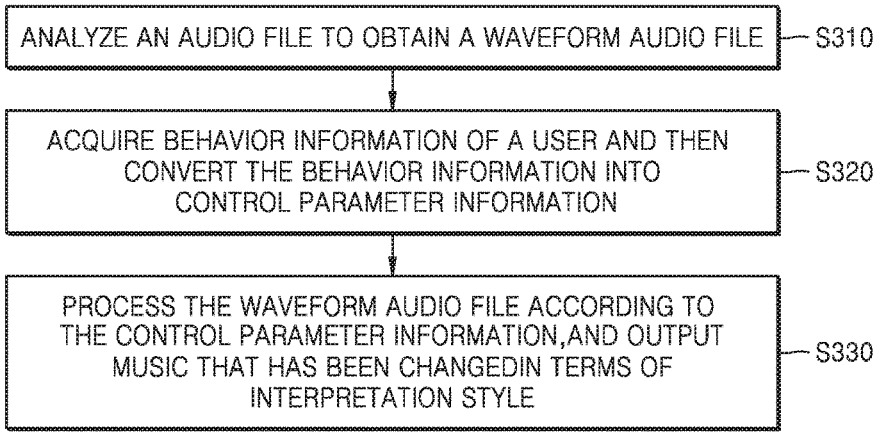
FIG. 3 is a flowchart of an embodiment of the method for changing the interpretation style of music according to the present invention.

As shown in FIG. 3, a flowchart of an embodiment of the method for changing the interpretation style of music according to the present invention is shown, comprising S310 to S330 which will be described as below by specific embodiments.

S310: An audio file is analyzed to obtain a waveform audio file.

Figure 4:
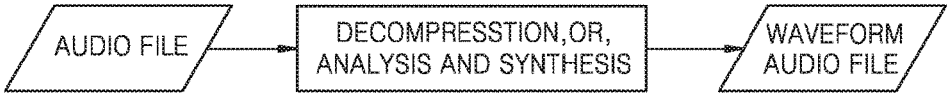
FIG. 4 is a flowchart of processing of input and output of an audio file analyzer or a decoder in another embodiment of the method for changing the interpretation style of music according to the present invention.

As shown in FIG. 4, a flowchart of processing of input and output of an audio file analyzer or a decoder in another embodiment of the method for changing the interpretation style of music according to the present invention is shown. The present invention will be described as below referring to FIG. 4.

The stored audio files include audio files of the compressed format, such as MP3, ACC, WMA, etc., and control audio files such as MIDI. For a compressed audio file, it is required to decompress the compressed audio file correspondingly to obtain a waveform audio file, while for a control audio file, for example, MIDI, it is required to perform analysis and synthesis to various control information therein.

The processing of input and output of an audio file analyzer or a decoder comprises the following steps of:

performing decompression, or, analysis and synthesis, to an audio file to generate a corresponding waveform audio file, specifically:

performing audio decompression or midi analysis and synthesis to a compressed audio file or midi file to generate a corresponding waveform audio file.

S320: Behavior information of a user is acquired and then converted into control parameter information.

As an embodiment of the present invention, the behavior information of a user comprises:

body movement information of a user, and/or humming information of a user.

Specifically, the body movement of the user results from the behavior of the user while listening to music, comprising: beating by swinging hands up and down, the force of swing representing the stress of the user; beating by tapping the feet, the force information characteristic of tapping the feet being not so obvious generally; some other body movements, for example, shaking the head, shrugging the shoulders, twisting the body.

As an embodiment of the present invention, acquiring behavior information of a user is performed by any one or more of the following equipment:

an acceleration sensor, a direction sensor, a three-axis gyroscope, a light sensor, an orientation sensor, a microphone, a camera and an ultrasonic gesture sensor.

To make an ordinary person skilled in the art understand the present invention better, the behavior information of a user acquired by the above various equipment will be briefly described hereinafter.

The acceleration sensor is electronic equipment capable of measuring acceleration. The acceleration refers to a force applied to an object when the object is accelerating. The acceleration may be a constant, for example g, or a variable. When a user hand-holds a terminal with an acceleration sensor embedded therein, or wears on the hand wearable equipment having an acceleration sensor, the swing of arms of the user may be detected, so that the force information and time information of the movement may be obtained. In addition, if a user wears the wearable equipment on the feet, the movement of tapping the feet may be detected.

Figure 5:
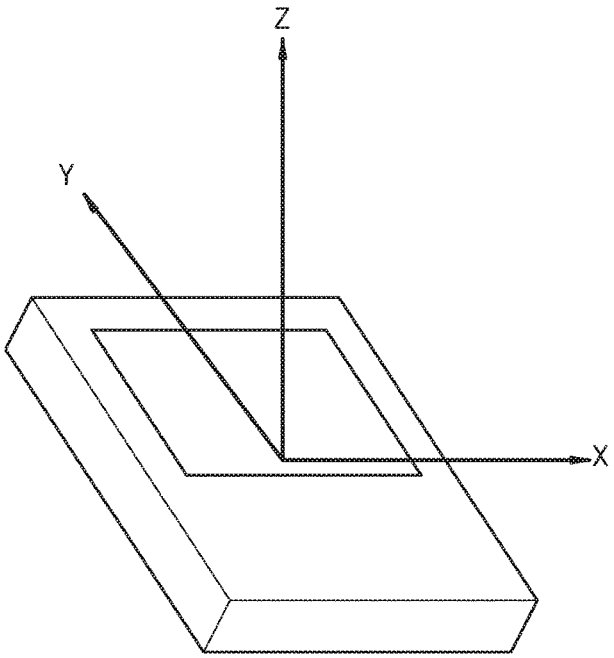
FIG. 5 is a schematic diagram of parameters of an acceleration sensor in another embodiment of the method for changing the interpretation style of music according to the present invention.

As shown in FIG. 5, a schematic diagram of parameters of an acceleration sensor in another embodiment of the method for changing the interpretation style of music according to the present invention is shown.

It can be seen from FIG. 5 that an acceleration gz in the vertical direction may be obtained in real time by the acceleration sensor.

The direction sensor, for example, a mobile phone direction sensor used in a mobile phone, may be applied in terminal equipment. Specifically, a mobile phone direction sensor is a component installed in a mobile phone to detect the directional state of the mobile phone itself. The mobile phone direction detection function may detect whether a mobile phone is held upright, upside down, leftward or rightward, or, faces up or faces down. A mobile phone having the direction detection function is more convenient and more humanized in use. For example, after the mobile phone is rotated, the picture on the screen may rotate automatically in a proper length-to-width proportion, and the text or menus may rotate simultaneously. Therefore, it is convenient for reading.

The three-axis gyroscope measures the positions, movement trajectories and accelerations in six directions simultaneously. With advantages of small size, light weight, simple structure and good reliability, the three-axis gyroscope has become a trend of the development of laser gyroscopes. The directions and positions measured by the three-axis gyroscope are stereoscopic. Particularly, in a case of playing large games, the advantage of stereoscopic directions and positions measured by the three-axis gyroscope is more prominent.

The light sensor, i.e., a photoreceptor, is a device capable of adjusting the brightness of a screen according to the brightness of ambient light. When in a bright place, a mobile phone will automatically turn off the keyboard light and slightly strengthen the brightness of the screen, resulting in saved power and better effects for looking at the screen. However, when in a dark place, the mobile phone will turn on the keyboard light automatically. Such a sensor mainly plays a role of saving the power of a mobile phone.

The orientation sensor is also known as an electronic compass or a digital compass which is a device for determining the North Pole by using the geomagnetic field. The orientation sensor is processed from a magnetoresistive sensor and a fluxgate. Such an electronic compass is able to bring more convenience for a user to use in coordination with a GPS and a map.

The microphone is a transducer for converting sound into electronic signals, as equipment for recording humming sound of a user. If a user listens to music with a pair of earphones, the microphone merely records the humming sound of the user; and, if the user listens to music with a loudspeaker, the microphone records both the humming sound of the user and the sound of the song from the loudspeaker.

As the camera, there are two kinds of cameras, i.e., digital cameras and analog cameras. An analog camera may convert analog video signals generated by video capturing equipment into digital signals and then store the digital signals into a computer. A digital camera may directly catch an image, and then transmit the image to the computer via a serial port, a parallel port or a USB interface. When a user stands in front of a terminal with a camera embedded therein, the camera may catch the gesture of the user.

The ultrasonic gesture sensor generates ultrasonic signals that can not be heard by human ears. When a person swings the hands before the equipment, the equipment can detect this movement based on the Doppler Effect.

This embodiment of the present invention merely lists the above equipment capable of acquiring the behavior information of a user. However, the equipment capable of acquiring the behavior information of a user is not limited thereto, and no detailed description will be repeated here.

Figure 6:
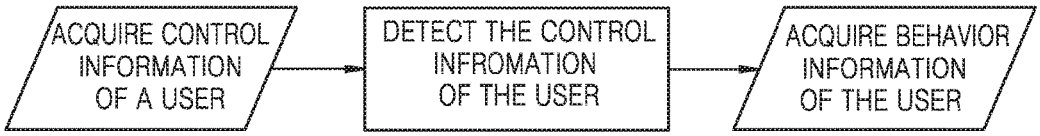
FIG. 6 is a flowchart of processing of input and output of acquisition of user control information in another embodiment of the method for changing the interpretation style of music according to the present invention.

As shown in FIG. 6, a flowchart of processing of input and output of acquisition of user control information in another embodiment of the method for changing the interpretation style of music according to the present invention is shown. The present invention will be described referring to FIG. 6.

The processing of input and output of acquisition of user control information specifically comprises the following steps of:

acquiring and detecting the control information of a user to acquire the behavior information of the user, wherein the behavior information of a user comprises body movement information of a user, and/or humming information of a user. Specifically:

detecting the control information corresponding to the behavior of the user while listening to music by available equipment, outputting the time information of a corresponding movement, force information of the movement and humming sound, wherein: the behavior of the user while listening to music comprises swinging the hands, tapping the feet, shaking the head and humming; and the available equipment comprises an acceleration sensor, a camera, an ultrasonic gesture sensor and a microphone. However, the available equipment is not limited thereto, and no detailed description will be repeated here.

As an embodiment of the present invention, converting the behavior information into control parameter information comprises:

converting the body movement information of the user into beat information, and/or converting the body movement information of the user into audio information of a specific musical instrument, and/or converting the humming information of the user into user audio information.

Specifically, converting the body movement information of the user into beat information comprises:

detecting the movement of user's body by the acceleration sensor, and recording the periodical change of acceleration as beat information when detecting a periodical change of the acceleration. In the present invention, one period of the acceleration is defined as a process during which the acceleration turns to a positive value from zero, then turns to a negative value and finally turns to zero again within a predetermined time range; or, a process during which the acceleration turns to a positive value from zero, then turns to a positive value and finally turns to zero again within a predetermined time range. Usually, the predetermine time range is about the time length of one beat.

For example, one period of raising one hand for beating is specifically:

supposed that an upward direction, which is vertical to a horizontal plane, is defined as the positive direction, at the start time t1 of raising one hand for beating, the initial speed is greater than 0, the acceleration is greater than zero, and the hand moves upward;

the initial speed is kept greater than zero while the acceleration turns to be less than zero, and the hand moves upward until the initial speed becomes zero, this moment is defined as the end time t2 of raising one hand for beating; and the time from the start time t1 of raising one hand for beating to the end time t2 of raising one hand for beating is defined as one period.

One period of dropping one hand for beating is specifically:

an upward direction, which is vertical to a horizontal plane, is defined as the positive direction, at the start time t3 of dropping one hand for beating, the initial speed is less than 0, the acceleration is greater than zero, and the hand moves downward;

the initial speed is kept less than zero while the acceleration turns to be less than zero, and the hand moves downward until the initial speed becomes zero, this moment is defined as the end time t4 of dropping one hand for beating; and the time from the start time t3 of dropping one hand for beating to the end time t4 of dropping one hand for beating is defined as one period.

Specifically, as shown in FIG. 7, schematic diagrams of a beating gesture of a user in another embodiment of the method for changing the interpretation style of music according to the present invention are shown.

Figure 7A:
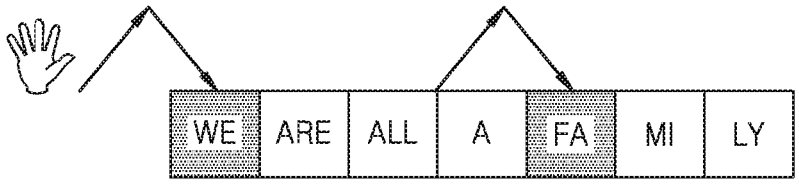
FIG. 7*a* is a schematic diagram of a beating gesture of a user in another embodiment of the method for changing the interpretation style of music according to the present invention.
Figure 7B:
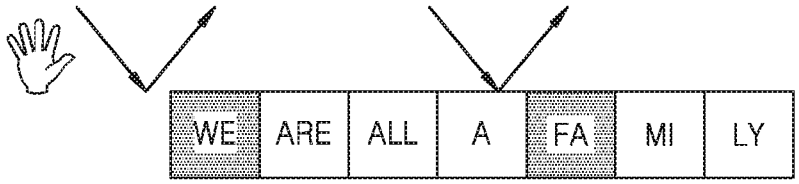
FIG. 7*b* is another schematic diagram of a beating gesture of a user in another embodiment of the method for changing the interpretation style of music according to the present invention.

According to the habit of the beating gesture of a user, there may be two conditions:

as shown in FIG. 7*a*, beating undergoes two periods, i.e., one period of raising one hand and one period of dropping the hand; and as shown in FIG. 7*b*, beating undergoes two periods, i.e., one period of dropping one hand and one period of raising the hand.

Specifically, converting body movement information of the user into audio information of a specific musical instrument comprises:

catching body movement information of the user to obtain time information and force information of a corresponding body movement; and controlling the specific musical instrument according to the time information and force information of the body movement to obtain the audio information of the specific musical instrument.

Figure 8:
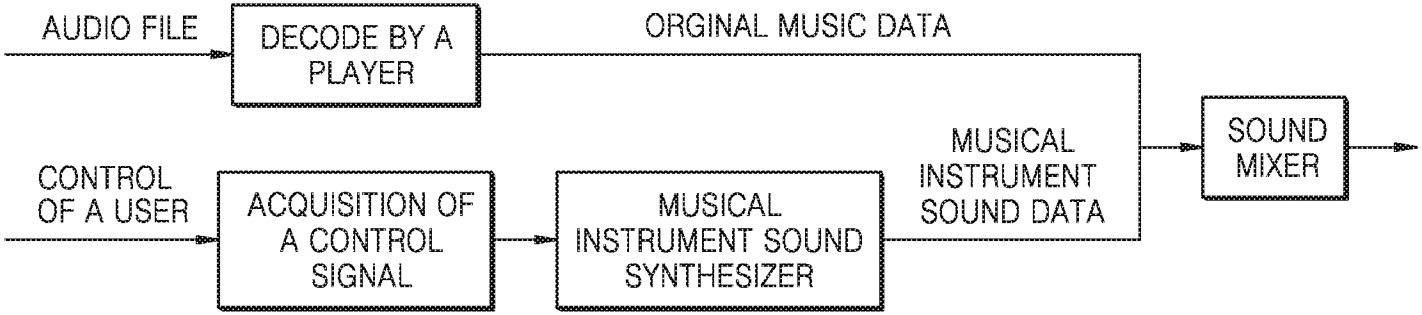
FIG. 8 is a flowchart of processing of adding in sound of a musical instrument in another embodiment of the method for changing the interpretation style of music according to the present invention.

Specifically, as shown in FIG. 8, a flowchart of processing of adding in sound of a musical instrument in another embodiment of the method for changing the interpretation style of music according to the present invention is shown. The present invention will be described as below referring to FIG. 8.

With respect to the demand that a user wants to add other music elements into an original song, for example, in this case, the equipment may play the role of a maraca. The sensor senses the swinging of the user, and then synthesizes the sound of the maraca by using the swinging rhythm and force as parameters.

The processing of adding in sound of a musical instrument specifically comprises the following steps of:

decoding an audio file by a player to acquire original music data;

acquiring control information from the control of a user, and then processing by a musical instrument sound synthesizer to obtain musical instrument sound data; and inputting the original music data and the musical instrument sound data into a sound mixer for further processing. Specifically:

the equipment is stored with a sound library of various musical instruments;

a user selects a favorite musical instrument before use, for example, a maraca;

when the user has uploaded a piece of music, the audio file analyzer or decoder decodes the music in real time to obtain waveform audio data;

the control information of the user is acquired and the movement of the user is caught in real time to obtain time and force information of the movement;

the musical instrument sound synthesizer is controlled according to the time and force information of the movement to obtain the sound of the corresponding musical instrument; and the sound mixer mixes the original waveform audio data with the musical instrument sound data.

Specifically, converting the humming information of the user into user audio information comprises:

receiving external sound information by the microphone, and performing signal processing to the external sound information to obtain the user audio information.

Figure 9:
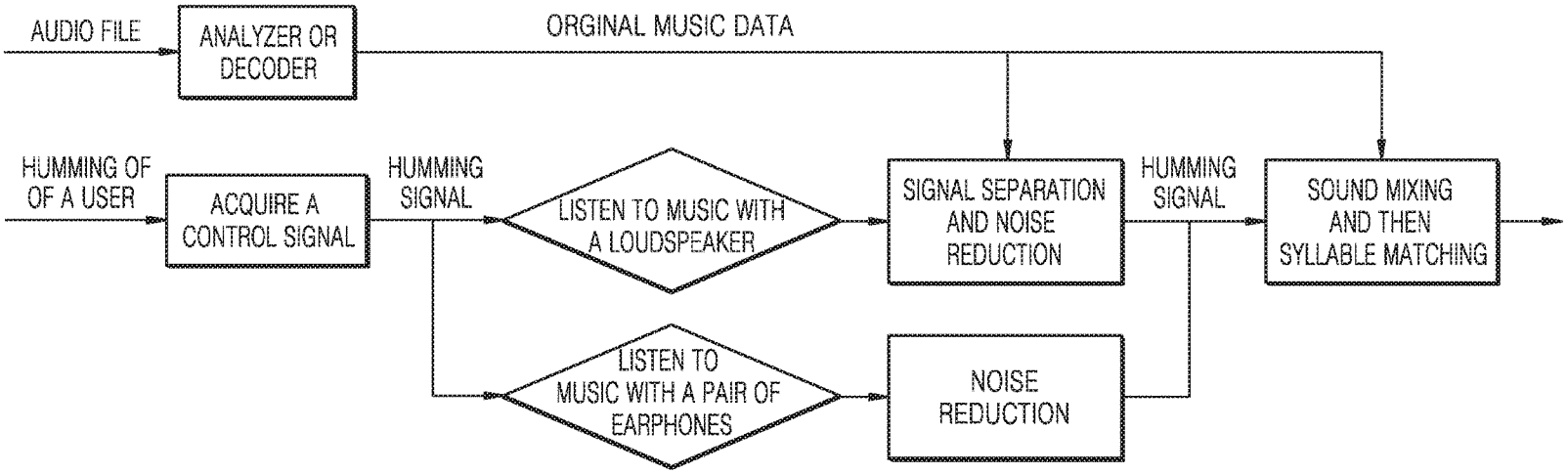
FIG. 9 is a flowchart of processing of chorusing by a user and a singer in another embodiment of the method for changing the interpretation style of music according to the present invention.

Specifically, as shown in FIG. 9, a flowchart of processing of chorusing by a user and a singer in another embodiment of the method for changing the interpretation style of music according to the present invention is shown, the present invention will be described as below referring to FIG. 9.

With respect to the demand that a user wants to add his/her own sound into the original sound, for example, in a case that the user sings along with the song while listening, the equipment mixes the sound of the user into the original song. The user may store or share the processed song over the internet.

The processing of chorusing by a user and a singer specifically comprises the following steps of:

inputting an audio file to an analyzer or a decoder to be processed, in order to generate an original music signals;

acquiring a control signal by the user's humming, performing signal separation and noise reduction to the signal if the user listens to the music with a loudspeaker, and matching in terms of syllables and then mixing the humming signal and the original music signal; and performing noise reduction to the signal if the user listens to the music with a pair of earphones, and matching in terms of syllables and then mixing the humming signal and the original music signal. Specifically:

after a user has uploaded a piece of music, an audio file analyzer or a decoder decodes the music in real time to obtain waveform audio data and plays the waveform audio data; meanwhile, an MIC records an audio humming signal of the user.

If the user listens to the music with a loudspeaker, the signal recoded by the MIC is mixed up with the original song and the background noise, so it is required to remove the original song and the background noise; in this case, it is required to use the original signal data as an auxiliary signal for purpose of processing, and the processed signal comprises the humming signal of the user only; and then, matching in terms of syllable and sound mixing are performed to the humming signal and the original song.

If the user listens to the music with a pair of earphones, there may be background noise in the signal recorded by the MIC, so it is required to remove the background noise, and the processed signal comprises the humming signal of the user only; and then, matching in terms of syllable and sound mixing are performed to the humming signal and the original song.

S330: The waveform audio file is processed according to the control parameter information and then music that has been changed in terms of interpretation style is output.

As an embodiment of the present invention, processing the waveform audio file according to the control parameter information and outputting music that has been changed in terms of interpretation style comprise any one or more of the following ways:

stressing and then outputting syllables in the waveform audio file according to the beat information.

Figure 10:
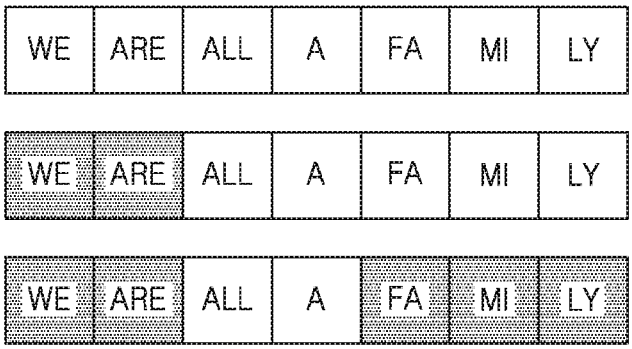
FIG. 10 is a schematic diagram of different tones of a same song in another embodiment of the method for changing the interpretation style of music according to the present invention.

Specifically, as shown in FIG. 10, a schematic diagram of different tones of a same song in another embodiment of the method for changing the interpretation style of music according to the present invention is shown. The present invention will be described as below referring to FIG. 10.

A same song may be interpreted by different tones. FIG. 10 shows different tones of a same song, wherein a deeper color represents a heavier tone, that is, the syllable is stressed more heavily. For example, a user is used to shaking a mobile phone for beating when holding the mobile phone to listen to music, so the speed of beating may be caught by an acceleration sensor, whereby the tone of the singer may be changed.

It can be seen from FIG. 10 that different users may have different interpretation styles for an original song "We are all a family". The syllable at the portion "We are" may be stressed, or syllables at both the portions "We are" and "family" may be stressed, in order to obtain the music in a desired interpretation style.

Figure 11:
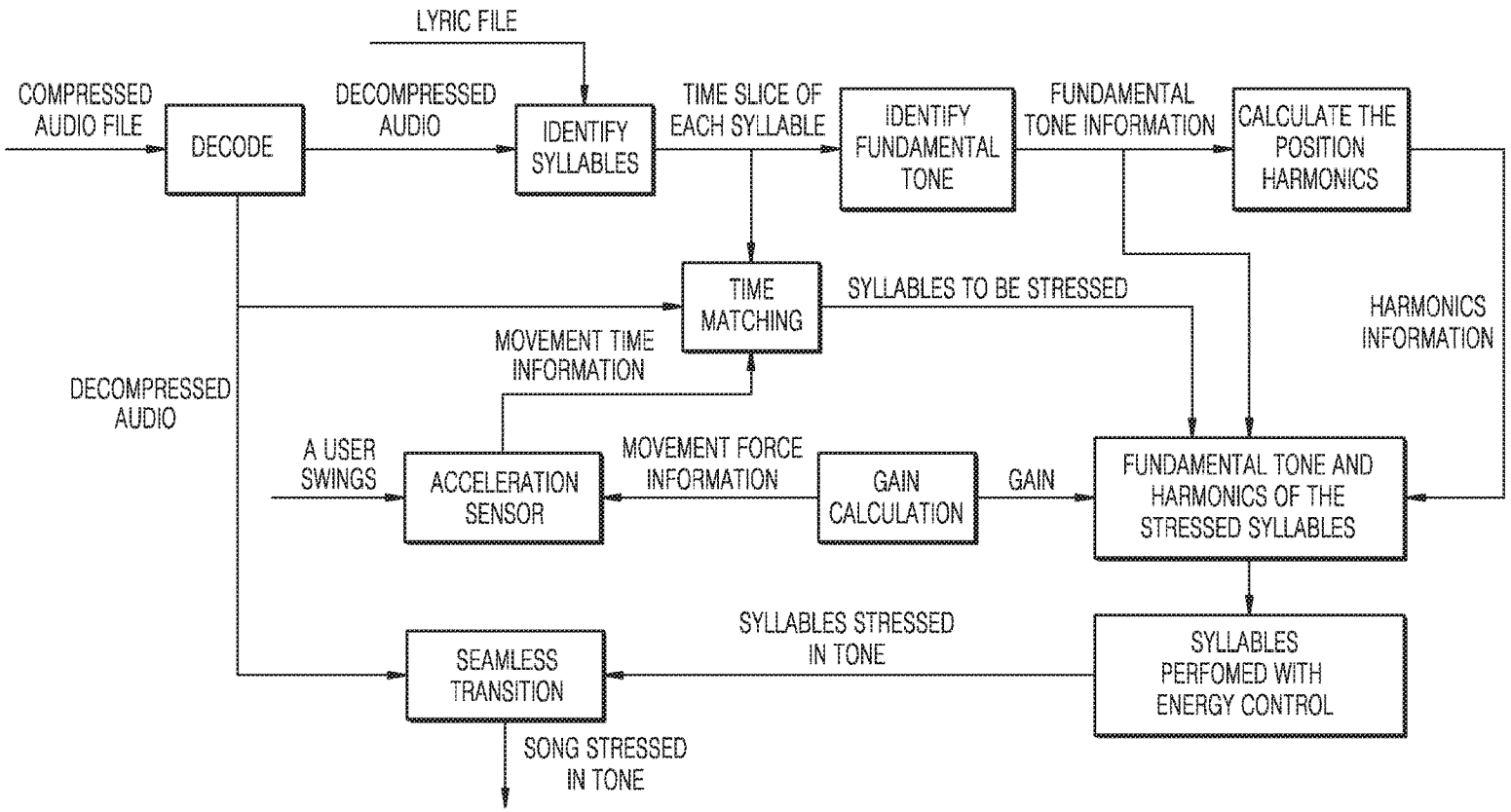
FIG. 11 is a flowchart of processing of stressing syllables in another embodiment of the method for changing the interpretation style of music according to the present invention.

Specifically, as shown in FIG. 11, a flowchart of processing of stressing syllables in another embodiment of the method for changing the interpretation style of music according to the present invention is shown. The present invention will be described as below referring to FIG. 11.

Changing a song by stressing syllables specifically comprises the following steps of:

decoding a compressed audio file to obtain the decompressed audio, identifying syllables in coordination with a lyric file to obtain the time slice of each syllable, further identifying the fundamental tone to obtain the fundamental tone information, and then calculating the position of harmonics to obtain the harmonics information;

detecting swinging of the user by an acceleration sensor to obtain the force information and time information of a movement, calculating and processing gains thereof;

meanwhile, performing time matching to the time information of a movement and the time slice of each syllable to obtain syllables to be stressed;

stressing the fundamental tone and harmonics of the syllables, in coordination with the syllables to be stressed in tone, the fundamental tone information, the harmonics information and the gain information, further performing energy control to the processed syllables in order to avoid overflow and make smooth energy, and finally obtaining syllables stressed in tone; and performing seamless transition, i.e., performing seamless transition to the decompressed audio which has been not yet processed and the audio which has been already processed in tone to obtain a song stressed in tone. Specifically:

a) after a user has uploaded a piece of music, a waveform audio file is obtained by an audio file analyzer or a decoder;

b) the system automatically identifies the time slice of each syllable (or each word) in the lyric, in this case, the lyric information may be used as auxiliary information for identification, and information about the time slice of each syllable is recoded, for example, "We": [t11, t12]

"are": [t13, t14]

"all": [t15, t16]

here, it is unnecessary to identify words "We", "are" and "all", as long as the voice or voice with background music is identified;

c) the system automatically calculates the fundamental frequency of each syllable (or each word), calculates the frequency position of harmonics of the fundamental frequency, and records it down;

d) when the user swings the mobile phone, the force of the movement is caught by the acceleration sensor, and the time of the movement is recorded;

e) the system matches the time obtained in d) with the time obtained in b), that is, determines into which time period of b) the d) falls, to obtain the time slice of each syllable to be stressed;

f) the syllable segment obtained in e) is transformed to a frequency domain;

g) a gain controller of the frequency domain is obtained by using the fundamental frequency and position of harmonics calculated in c);

h) the gain value of the gain controller depends upon the force parameter obtained in d), that is, the larger the force is, the larger the gain is;

i) the gain controller is applied to step f);

j) then, the syllable segment is inversely transformed to a time domain;

k) energy smoothing is performed to the processed and stressed syllables (or, performed after step i), and energy smoothing and anti-overflow processing are performed in the frequency domain; and l) the processed syllables are spliced with the audio that has not yet been processed in the time domain.

The audio information of the specific musical instrument is mixed with the waveform audio file and then output.

The user audio information and the waveform audio file are matched in terms of syllables, superimposed and output.

As an embodiment of the present invention, outputting music that has been changed in terms of interpretation style comprises:

outputting the music that has been changed in terms of interpretation style in real time or in non-real time.

Specifically, outputting the music that has been changed in terms of interpretation style in real time after stressing syllables in the waveform audio file according to the beat information comprises:

stressing syllables in the waveform audio file when detecting a periodical change of the acceleration; and stressing syllables in the waveform audio file and then outputting when detecting a next periodical change of the acceleration within a predetermined time.

Specifically, both changes, i.e., stressing syllables and adding a musical instrument, may realize output in real time, that is, a user controls while listening to music. The final signal heard by the user comprises the original song and the control expressions simultaneously.

After catching the movement of the user and processing the song, the timing of playing in real time is as follows. Given that the habitual beating gesture of the user is: a hand rises at the moment before the stressed syllables and then drops. As shown in the following figure, "We" and "fa" are stressed; and, according to the habitual gesture, a hand rises before these syllables and drops at these syllables. Raising a hand and dropping a hand actually appear in pair. Further, the speed and amplitude of raising a hand can reflect the strength of stressing. The timing problem may be solved by catching the movement of raising a hand.

Figure 12:
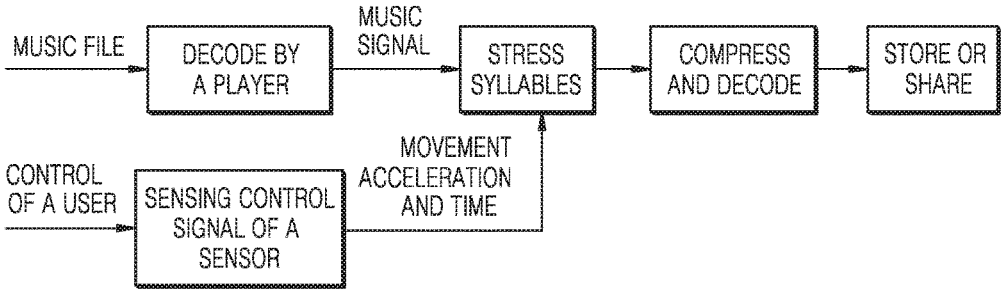
FIG. 12 is a flowchart of processing of storing or sharing a processed song in another embodiment of the method for changing the interpretation style of music according to the present invention.

As shown in FIG. 12, a flowchart of processing of storing or sharing a processed song in another embodiment of the method for changing the interpretation style of music according to the present invention is shown. The present invention will be described as below referring to FIG. 12.

Various processing by a music style changer may realize output in non-real time, that is, a user may store the changed music into a local disk or share it over the internet.

Wherein, as there is no real-time requirement for syllable stressing, the equipment may stress syllables after acquiring accurate control information of the user. Specifically:

the process of storing or sharing the processed song in non-real time specifically comprises the following steps of:

decoding a music file by a player to obtain a music signal;

obtaining sensing control information of a sensor by the control of a user and outputting a corresponding movement acceleration and time; and stressing syllables in combination with the music signal as well as the movement acceleration and time, compressing and decoding the processed result, and finally storing or sharing. Specifically:

pre-processing a song to obtain the syllables, the fundamental tone and the harmonics corresponding to the syllables;

catching a movement of the user by an acceleration sensor, and recording acceleration and time information of the movement of the user only differencing from the timing requirement in the real-time processing, to obtain [gz(t21), gz(t22), . . . , gz(t2*n*)];

processing all syllables to be stressed, and then splicing the syllables together;

compressing and coding the processed song;

storing the song in a local disk or sharing it over the internet.

In the embodiments as provided by the present invention, by analyzing an audio file to obtain a waveform audio file; acquiring behavior information of a user, and converting the behavior information into control parameter information; and, processing the waveform audio file according to the control parameter information and outputting the music that has been changed in terms of interpretation style, a user may change the interpretation style of music according to the current emotional needs, so that the diverse demands of the user are satisfied, and the user experience is improved. The above solutions as provided by the present invention just make minor modification to the existing systems, and hence will not influence the system compatibility. Moreover, the implementations are both simple and highly effective.

Further, when a user swings a mobile phone while listening to music, the mobile phone can let the user listen to different interpretation styles of the singer according to the force of swinging. Therefore, the user does not listen to music passively any more, and may change the music according to the current emotional needs and thus enjoy own music world. Meanwhile, the user may store the music conforming to the current emotion or share it over the internet.

Further, outputting a waveform audio file in real time solves the time delay in the prior art, so that the user can better interactively share the music that has been changed in terms of interpretation style with friends in real time, and the user experience is thus improved.

Figure 13:
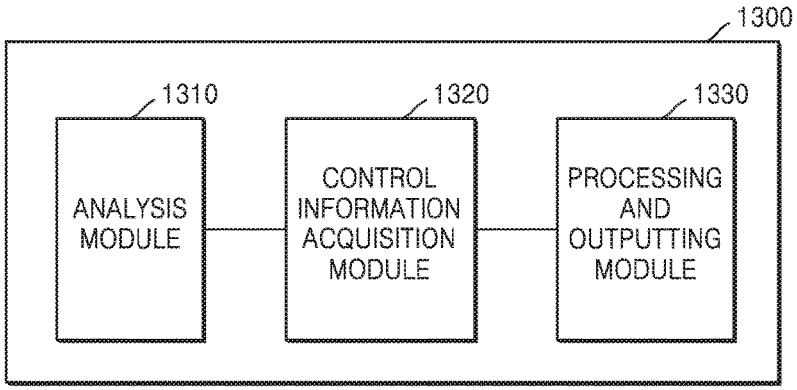
FIG. 13 is a structure diagram of an embodiment of a device for changing the interpretation style of music according to the present invention.

FIG. 13 is a structure diagram of an embodiment of a device for changing the interpretation style of music according to the present invention. As shown in FIG. 13, the device 1300 for changing the interpretation style of music in this embodiment comprises an analysis module 1310, a control information acquisition module 1320 and a processing and outputting module 1330.

The analysis module 1310 is configured to analyze an audio file to obtain a waveform audio file.

The control information acquisition module 1320 is configured to acquire behavior information of a user and convert the behavior information into control parameter information.

Specifically, the behavior information of a user acquired by the control information acquisition module 1320 comprises:

body movement information of a user, and/or humming information of a user.

Specifically, the control information acquisition module 1320 acquires the behavior information of a user by any one or more of the following equipment:

an acceleration sensor, a direction sensor, a three-axis gyroscope, a light sensor, an orientation sensor, a microphone, a camera and an ultrasonic gesture sensor.

The behavior information of a user acquired by the above equipment may refer to the descriptions in the method and will not be repeated here.

Specifically, the control information acquisition module 1320 is configured to convert the behavior information into control parameter information, comprising:

converting the body movement information of the user into beat information, and/or converting the body movement information of the user into audio information of a specific musical instrument, and/or converting the humming information of the user into user audio information.

Specifically, the control information acquisition module 1320 is configured to convert the body movement information of the user into beat information, comprising:

detecting the change of user's body by the acceleration sensor, and recording the periodical change of acceleration as beat information when detecting a periodical change of the acceleration.

Specifically, the control information acquisition module 1320 is configured to convert body movement information of the user into audio information of a specific musical instrument, comprising:

catching body movement information of the user to obtain time information and force information of a corresponding body movement; and controlling the specific musical instrument according to the time information and force information of the body movement to obtain the audio information of the specific musical instrument.

Specifically, the control information acquisition module 1320 is configured to convert the humming information of the user into user audio information, comprising:

receiving external sound information by the microphone, and performing signal processing to the external sound information to obtain the user audio information.

The processing and outputting module 1330 is configured to process the waveform audio file according to the control parameter information and output the music that has been changed in terms of interpretation style, comprising any one or more of the following ways:

stressing and then outputting syllables in the waveform audio file according to the beat information;

mixing and then outputting the audio information of the specific musical instrument with the waveform audio file; and matching the user audio information and the waveform audio file in terms of syllables, superimposing and outputting.

Further, the processing and outputting module 1330 is configured to output the music that has been changed in terms of interpretation style, comprising:

outputting the music that has been changed in terms of interpretation style in real time or in non-real time.

Specifically, the processing and outputting module 1330 is configured to output the music that has been changed in terms of interpretation style in real time after stressing syllables in the waveform audio file according to the beat information, comprising:

stressing syllables in the waveform audio file when detecting a periodical change of the acceleration; and stressing syllables in the waveform audio file and then outputting when detecting a next periodical change of the acceleration within a predetermined time.

In the above embodiment of the present invention, by analyzing an audio file by the analysis module 1310 to obtain a waveform audio file; acquiring behavior information of a user and converting the behavior information into control parameter information by the control information acquisition module 1320; and, processing the waveform audio file according to the control parameter information and outputting the music that has been changed in terms of interpretation style by the processing and outputting module 1330, a user may change the interpretation style of music according to the current emotional needs, so that the diverse demands of the user are satisfied, and the user experience is improved. The above solutions as provided by the present invention just make minor modification to the existing systems, and hence will not influence the system compatibility. Moreover, the implementations are both simple and highly effective.

As an embodiment of the present invention, the present invention further provides terminal equipment. Wherein, the terminal equipment comprises the device for changing the interpretation style of music as disclosed above. That is, in practical applications, the device is generally in a form of terminal equipment. The terminal equipment comprises the device for changing the interpretation style of music as shown in FIG. 13.

Further, when a user swings a mobile phone while listening to music, the mobile phone can let the user listen to different interpretation styles of the singer according to the force of swinging. Therefore, the user does not listen to music passively any more, and may change the music according to the current emotional needs and thus enjoy own music world. Meanwhile, the user may store the music conforming to the current emotion or share it over the internet.

Further, outputting a waveform audio file in real time solves the time delay in the prior art, so that the user can better interactively share the music that has been changed in terms of interpretation style with friends in real time, and the user experience is thus improved.

It should be appreciated by the person skilled in the art that the present invention may involve devices for implementing one or more operations described therein. The device may be designed and manufactured for dedicated purposes as required, or may further comprise well known devices found in general-purpose computers which are activated or reconstituted selectively by the programs stored therein. Such computer programs may be stored in device (such as a computer) readable media or stored in any type of medias adaptive to store electronic instructions and coupled to a bus. Such computer readable media includes, but not limited to, any type of disks/discs (including floppy disk, hard disk, optical disk, CD-ROM and magneto optical disk), read-only memory (ROM), random access memory (RAM), Erasable programmable Read-Only Memory (EPROM), electrically erasable ROM (EEPROM), flash memory, magnetic card or fiber card. That is to say, the readable media includes any mechanism storing or transmitting information in device (for example, the computer) readable form.

It should be appreciated by the person skilled in the art that each block as well as the combination of the blocks in the structural block graphs and/or block graphs and/or flowcharts may be implemented through computer program instructions. It should be appreciated by the person skilled in the art that these computer program instructions may be provided to general-purpose computer, dedicated computer or other processors capable of programming the data processing methods, to generate machines, so as to implement the methods specified in the block(s) of the structural block graphs and/or block graphs and/or flowcharts through the instructions executed on the computer or other processors capable of programming the data processing methods.

It should be appreciated by the person skilled in the art that the various operations, methods, steps in the flow, measures and schemes discussed in the present invention can be alternated, modified, combined or deleted. Furthermore, other operations, methods, steps in the flow, measures and schemes involving the various operations, methods, steps in the flow, measures and schemes discussed in the present invention may also be alternated, modified, rearranged, dissolved, combined or deleted. Furthermore, other operations, methods, steps in the flow, measures and schemes having the same functions with the various operations, methods, steps in the flow, measures and schemes discussed in the present invention may also be alternated, modified, rearranged, dissolved, combined or deleted.

The description above only illustrates part of the embodiments of the present invention. It should be pointed out that, various modifications and polishes may be made by a person skilled in the art without departing from the principle of the present invention. These modification and polishes shall also be regarded as the extent of protection of the present invention.

What is claimed is:

1. A method comprising:

generating control parameter information based on user behavior information; and outputting an audio file according to the control parameter information, wherein the outputting of the audio file comprises stressing at least one syllable in the audio file according to the control parameter information.

2. The method of claim 1, wherein the user behavior information comprises at least one of body movement information and humming information.

3. The method of claim 2, wherein the generating the control parameter information comprises:

detecting a periodical change in acceleration of user's body movement based on the body movement information; and generate beat information based on the detected periodic change.

4. The method of claim 2, wherein the generating the control parameter information comprises:

performing signal processing on the humming information; and generating user audio information based on the processed humming information.

5. The method of claim 2, wherein generating of the control parameter information comprises:

generating musical instrument audio information by controlling a digital musical instrument according to the user behavior information.

6. The method of the claim 2, wherein the outputting of the audio file comprises outputting the audio file based on syllable matching between the humming information and the audio file.

7. The method of claim 1, wherein the outputting of the audio file comprises processing the audio file in real time with respect to the control parameter information.

8. The method of claim 1, wherein the outputting of the audio file comprises stressing the at least one part of the audio file in response to detecting a periodic change in acceleration of user's body movement.

9. An electronic device comprising:

a memory storing instructions; and a processor configured to execute the stored instructions to:

generate control parameter information based on user behavior information; and output an audio file according to the control parameter information, wherein the processor is configured to stress at least one syllable in the audio file according to the control parameter information.

10. The electronic device of claim 9, wherein the user behavior information comprises at least one of body movement information and humming information.

11. The electronic device of claim 10, wherein the processor is configured to:

detect a periodical change in acceleration of user's body movement based on the body movement information; and generate beat information based on the detected periodic change.

12. The electronic device of claim 10, wherein the processor is configured to:

perform signal processing on the humming information; and generate user audio information based on the processed humming information.

13. The electronic device of claim 10, wherein processor is configured to acquire musical instrument audio information generated by controlling a digital musical instrument according to the user behavior information.

14. The electronic device of the claim 10, wherein processor is configured to output the audio file based on syllable matching between the humming information and the audio file.

15. The electronic device of claim 9, wherein the processor is configured to process the audio file in real time with respect to the control parameter information.

16. The electronic device of claim 9, wherein the processor is configured to stress the at least one part in the audio file in response to detecting a periodic change in acceleration.

* * * * *